US008167109B2

(12) United States Patent
Furihata

(10) Patent No.: US 8,167,109 B2
(45) Date of Patent: May 1, 2012

(54) MEDIUM PROCESSING APPARATUS

(75) Inventor: Hideki Furihata, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 30 days.

(21) Appl. No.: 12/070,223

(22) Filed: Feb. 15, 2008

(65) Prior Publication Data

US 2008/0196996 A1 Aug. 21, 2008

(30) Foreign Application Priority Data

Feb. 19, 2007 (JP) ..... 2007-037454

(51) Int. Cl.
*G07D 11/00* (2006.01)

(52) U.S. Cl. ..... 194/210

(58) Field of Classification Search ..... 194/210, 194/205, 206, 207; 235/379, 380
See application file for complete search history.

(56) References Cited

U.S. PATENT DOCUMENTS

| | | | | |
|---|---|---|---|---|
| 3,715,031 | A | 2/1973 | Okkonen | |
| 3,966,047 | A | 6/1976 | Steiner | |
| 4,030,726 | A * | 6/1977 | Biedermann | 271/246 |
| 4,035,614 | A * | 7/1977 | Frattarola et al. | 235/431 |
| 4,585,125 | A | 4/1986 | Mori et al. | |
| 5,150,894 | A * | 9/1992 | Ricciardi | 271/302 |
| 5,259,490 | A | 11/1993 | Gardellini | |
| 6,068,187 | A * | 5/2000 | Momose | 235/449 |
| 6,412,619 | B1 * | 7/2002 | Ito et al. | 194/206 |
| 6,606,475 | B1 * | 8/2003 | Maier et al. | 399/302 |
| 6,782,987 | B1 | 8/2004 | Abe et al. | |
| 6,938,892 | B2 | 9/2005 | Abe et al. | |
| 2003/0075596 | A1 * | 4/2003 | Koakutsu | 235/379 |
| 2004/0251588 | A1 | 12/2004 | Panini et al. | |
| 2004/0257626 | A1 * | 12/2004 | Panini et al. | 358/474 |
| 2005/0011722 | A1 * | 1/2005 | Nomura | 194/207 |

FOREIGN PATENT DOCUMENTS

| | | | |
|---|---|---|---|
| JP | 51062797 | A | 5/1976 |
| JP | 59058876 | U | 4/1984 |

(Continued)

OTHER PUBLICATIONS

European Search Report mailed Mar. 24, 2009.

*Primary Examiner* — Stefanos Karmis
*Assistant Examiner* — Mark Beauchaine
(74) *Attorney, Agent, or Firm* — Nutter McClennen & Fish LLP; John J. Penny, Jr.; Christina M. Sperry

(57) ABSTRACT

The medium conveying mechanism includes a motor, a driving pulley adapted to be rotated by the motor, an endless belt wound around the driving pulley and adapted to be moved by the driving pulley in a belt moving direction, a first driven pulley around which the endless belt is wound and adapted to be rotated by the endless belt, a first conveying roller disposed on the medium conveying path and adapted to be rotated by the first driven pulley to convey the medium, and a first pressure roller disposed to correspond to the first conveying roller so as to press the medium against the first conveying roller. A distance in the medium conveying path between the information reading position and a nip portion between the first conveying roller and the first pressure roller is shorter than a distance between a leading end of the conveyed medium and back end of the recording area. The first driven pulley is disposed upstream from the driving pulley in the belt moving direction.

12 Claims, 6 Drawing Sheets

FOREIGN PATENT DOCUMENTS

| | | | |
|---|---|---|---|
| JP | 63008892 | A | 1/1988 |
| JP | 05-258148 | | 10/1993 |
| JP | 05-258151 | | 10/1993 |
| JP | 2001-344635 | | 12/2001 |
| JP | 2002-109613 | | 4/2002 |
| JP | 2004-206362 | | 7/2004 |

* cited by examiner

MEDIUM PROCESSING APPARATUS

Priority is claimed from Japanese Patent Application No. 2007-037454 filed Feb. 19, 2007, the entire disclosure of which, including specification, drawings and claims, is incorporated herein by reference.

BACKGROUND

The present invention relates to a medium processing apparatus which reads information such as magnetic characters or image information carried on sheet-shaped mediums such as checks, while conveying the sheet-shaped mediums along a conveying path sheet by sheet, and more specifically, to a medium processing apparatus which can prevent a variation in conveying speed of sheet-shaped mediums such that the carried information of the sheet-shaped mediums can be accurately read.

In banking facilities such as banks, closed checks and bills (such as stocks and bonds) are put into a check reading apparatus so as to read surface images and magnetic ink characters on the checks and bills. Then, the checks and bills are sorted depending on the read results. Recently, as electric payments are spread, the read image data and magnetic ink characters are processed by computers so as to manage the checks and bills. Patent Documents 1 and 2 disclose such a check reading apparatus.

As disclosed in Patent Documents 1 and 2, a check conveying mechanism of the check reading apparatus transmits the torque of a conveying motor to a plurality of conveying rollers, disposed along a check charring path, through an endless belt and carries checks along the conveying path while sequentially transferring the checks from an upstream conveying roller to a downstream conveying roller.

The checks are conveyed while the magnetic ink characters and image data are read by a magnetic head and an image sensor disposed in the conveying path. When the conveying speed of the checks is varied during the reading operation, a detection signal pattern obtained from the magnetic head is also varied. As a result, the reading precision of magnetic ink character by the magnetic head is degraded. Therefore, the conveying speed of the checks needs to be constantly maintained during the reading operation.

Patent Document 1: Japanese Patent Publication No. 2004-206362A

Patent Document 2: US Patent Publication No. 2004/0257626 A1

In the conveying mechanism in which the endless belt is wound around the conveying rollers disposed along the conveying path in a tensile state so as to be driven by the conveying motor, when a tensile force acting on the endless belt is varied, a load acting on spindles of the conveying rollers around which the endless belt is wound is varied by the variation in tensile force such that a deflection amount of the spindles is varied. The tensile force of the endless belt is varied by a load generated when a check enters nip portions of the conveying rollers and pressure rollers. Further, as the endless belt is separated from the driven position by the conveying motor, variations in the load applied from the respective conveying rollers around which the endless belt is wound and loads acting on the spindles due the variations in load are sequentially added and amplified. Therefore, the tensile force is significantly varied in a portion of the endless belt separated from the driven position.

In the spindles of the conveying rollers of which portions where the variation in tension is large are wound by the endless belt, the deflection amount is significantly varied depending on the variation in tension. When the variation in deflection amount of the spindles of the conveying rollers is large, the distance between shafts of the conveying rollers and the pressure rollers is varied, and a deflection amount of the belt and a driven amount of the conveying motor are out of proportion such that the check conveying speed (conveying pitch) is disturbed.

Meanwhile, when a check is fed to the nip portions of the conveying rollers and the pressure rollers, a reaction force is caused by a nip force so as to act in the reverse direction to the conveying direction with respect to the check. When the reaction force is large, the disturbance occurs in the check conveying speed.

SUMMARY

It is therefore an object of at least one embodiment of the invention to provide a medium processing apparatus which can prevent disturbance in the conveying speed of sheet-shaped mediums while carried information is read, and can read the carried information of the sheet-shaped medium with high precision.

In order to solve the above-mentioned problems, there is provided in at least one embodiment of the invention a medium processing apparatus comprising: a medium conveying mechanism operable to convey a sheet medium along a medium conveying path; and an information reading section operable to read information recorded on an recording area of the conveyed medium when the recording area of the medium passes through an information reading position on the medium conveying path; wherein the medium conveying mechanism includes: a motor; a driving pulley adapted to be rotated by the motor; an endless belt wound around the driving pulley and adapted to be moved by the driving pulley in a belt moving direction; a first driven pulley around which the endless belt is wound and adapted to be rotated by the endless belt; a first conveying roller disposed on the medium conveying path and adapted to be rotated by the first driven pulley to convey the medium; and a first pressure roller disposed to correspond to the first conveying roller so as to press the medium against the first conveying roller; wherein a distance in the medium conveying path between the information reading position and a nip portion between the first conveying roller and the first pressure roller is shorter than a distance between a leading end of the conveyed medium and back end of the recording area; and wherein the first driven pulley is disposed upstream from the driving pulley in the belt moving direction.

The position of the endless belt where a variation in tension is the smallest is the upstream side of the moving direction of the endless belt in a tight side, with respect to the driving pulley which is wound by the endless belt so as to drive the endless belt. Therefore, the driven pulley of the first conveying roller in the endless belt is disposed in a portion adjacent to the upstream side of the moving direction of the endless belt, with respect to the driving pulley. Thus, the first conveying roller can be driven with a small speed variation.

In the medium processing apparatus according to at least one embodiment of the invention, a portion of the first conveying roller where the variation in tension in the endless belt is smaller than the other conveying rollers is wound by the endless belt. Therefore, in the portion of the endless belt in which the first conveying roller is wound, a large variation in tension is not generated when the sheet-shaped medium is fed to the first conveying roller. Therefore, when the sheet-shaped medium is fed to the first conveying roller while the carried information is read, the conveying speed of the sheet-shaped medium is prevented from being disturbed. As a result, the reading precision of the carried information by the information reading unit is prevented from being degraded.

The endless belt may have teeth thereon; and the driving pulley and the first driven pulley may have teeth thereon so as to be engaged with the endless belt. Therefore, a variation in speed of the driving pulley and the driven pulleys can be reduced.

In a case where the medium conveying path has relatively large length, the medium conveying mechanism may further includes: a second driven pulley around which the endless belt is wound and adapted to be rotated by the endless belt; a second conveying roller disposed between the first conveying roller and the information reading position on the medium conveying path and adapted to be rotated by the second driven pulley to convey the medium; and a second pressure roller disposed to correspond to the second conveying roller so as to press the medium against the second conveying roller, wherein the second driven pulley is disposed upstream from the first driven pulley in the belt moving direction.

As such, when the plurality of conveying rollers by which the sheet-shaped medium is fed while the carried information is read is provided, the conveying rollers are disposed adjacent to the upstream side of the driving pulley for driving the endless belt in the tight side in the endless belt. Then, the portion of the endless belt where the variation in tension is smaller than the other rollers is wound around the first and second conveying rollers. Therefore, when the sheet-shaped medium is fed to the conveying rollers while the carried information is read, the conveying speed can be prevented from being disturbed. As a result, it is possible to prevent or avoid the degradation of the reading precision of the carried information by the information reading unit.

The medium conveying mechanism may further include a third driven pulley around which the endless belt is wound and adapted to be rotated by the endless belt; a third conveying roller disposed on the medium conveying path and adapted to be rotated by the third driven pulley to convey the medium; and a third pressure roller disposed to correspond to the third conveying roller so as to press the medium against the third conveying roller. A diameter of the first conveying roller may be larger than a diameter of the third conveying roller. A diameter of the first pressure roller may be larger than a diameter of the third pressure roller. A diameter of the second conveying roller may be larger than a diameter of the third conveying roller. A diameter of the second pressure roller may be larger than a diameter of the third pressure roller.

As the outer diameters of the rollers are set to be larger, it is possible to reduce a reaction force acting on the sheet-shaped medium when the sheet-shaped medium is fed to a nip portion. As a result, when the sheet-shaped medium, which is fed while the carried information is read, is fed to the first or second conveying roller, the conveying speed can be prevented from being disturbed. Therefore, it is possible to prevent or avoid the degradation of the reading precision of the carried information by the information reading unit.

When the medium processing apparatus is used as a check processing apparatus, the information reading section may include a magnetic head operable to read a magnetic ink character. Further, the information reading section may include an image reading section. When the magnetic head is disposed downstream from the image reading section in the belt moving direction, it is preferable that the magnetic head, which requires speed precision to read magnetic information such as barcodes, be disposed on the side of the driving pulley. Preferably, the first driven pulley may be the driving pulley which is driven by the motor. Then, it is possible to reduce the variation in speed for the endless belt.

According to the medium processing apparatus of at least one embodiment of the present invention, the portion where the variation in tension in the endless belt is smaller is wound around the conveying roller by which the sheet-shaped medium is conveyed while the carried information is read. Therefore, since it is possible to prevent a variation in a load acting on the conveying roller when the sheet-shaped medium is fed, the disturbance in the conveying speed of the sheet-shaped medium can be prevented while the carried information is read. Accordingly, it is possible to prevent or avoid the degradation of the reading precision of the carried information, which is cased by the disturbance in the conveying speed.

Further, the outer diameters of the conveying rollers and the pressure rollers, by which the sheet-shaped medium is fed while the carried information is read, are set to be larger than those of the other conveying rollers and the other pressure rollers, respectively. Accordingly, it is possible to reduce a reaction force acting on the sheet-shaped medium which is fed to the nip portions of the conveying rollers and the pressure rollers. Therefore, it is possible to prevent the disturbance in the conveying speed of the sheet-shaped medium while the carried information is read. As a result, it is possible to prevent the degradation of the reading precision of the carried information, which is caused by the disturbance of the conveying speed.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Hereinafter, a check processing apparatus to which the present invention is applied will be described in detail with reference to the drawings.

(Entire Construction)

Figure 1:
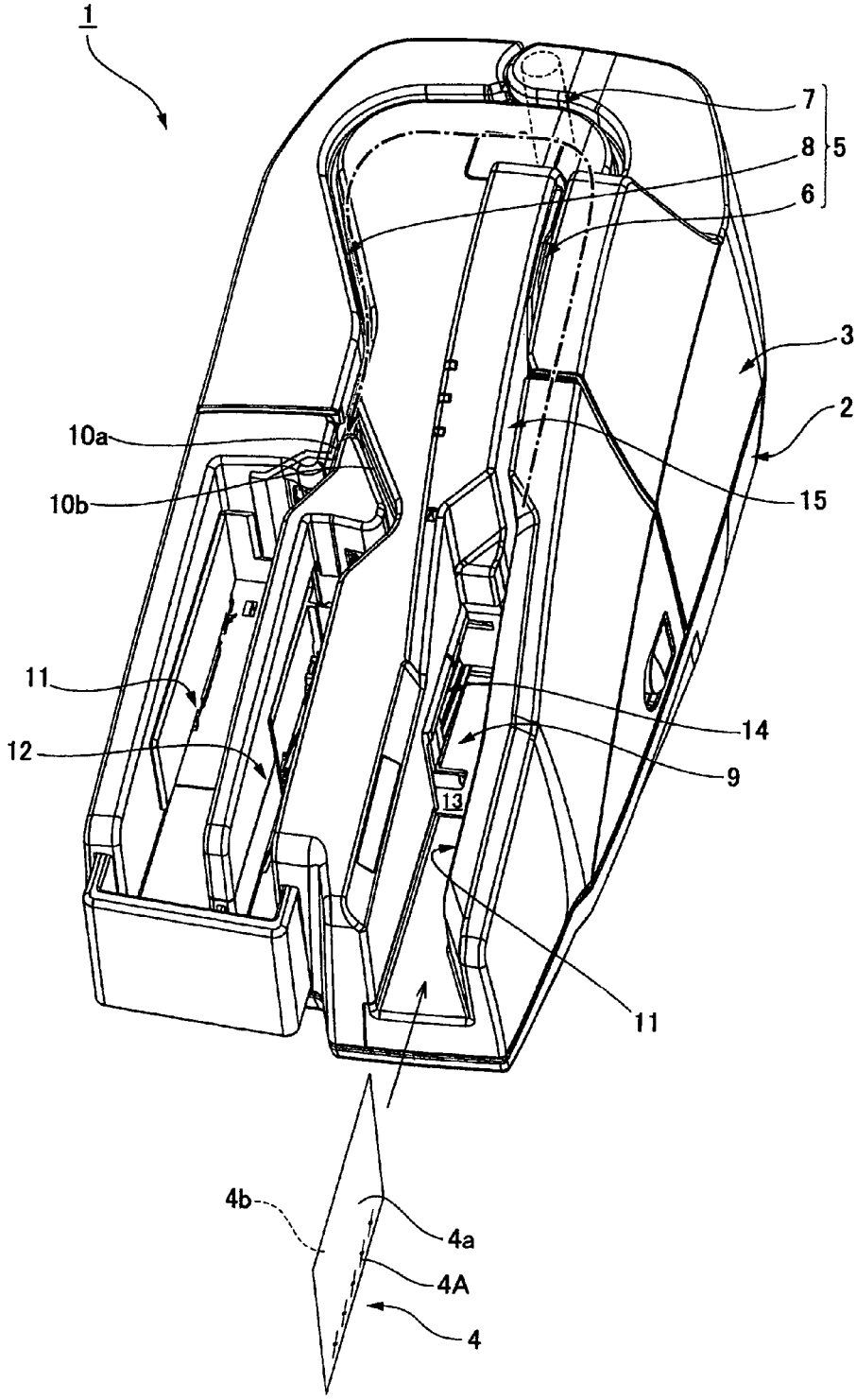
FIG. 1 is an external perspective view of a check processing apparatus to which the present invention is applied.
Figure 2:
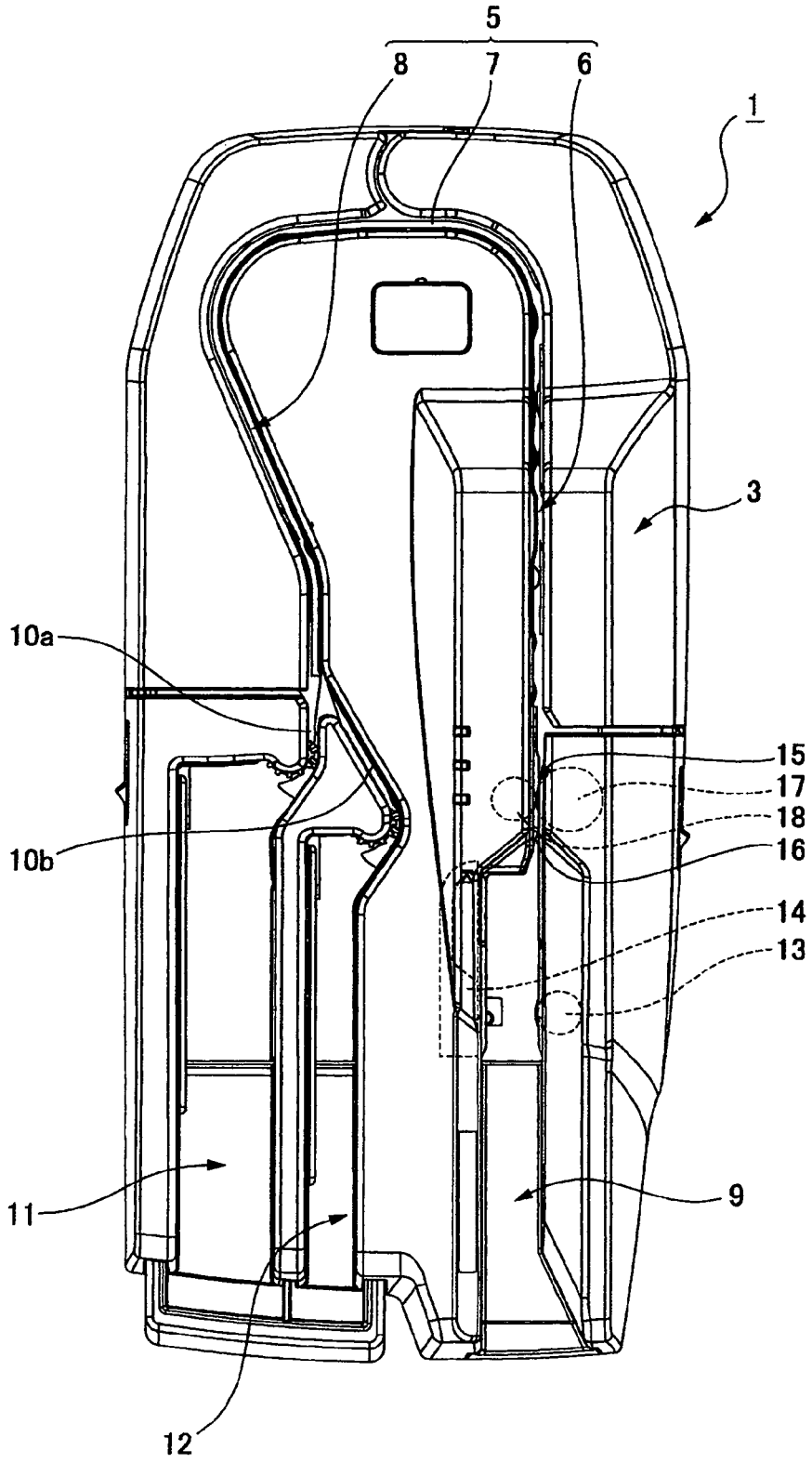
FIG. 2 is a plan view of the check processing apparatus of FIG. 1.

As shown in FIGS. 1 and 2, the check processing apparatus 1 includes a main body case 2 and a lid case 3 placed on the main body case 2. Inside these cases, respective components are assembled. The lid case 3 has a conveying path 5 for checks 4 (sheet-shaped mediums), the conveying path 5 being formed of a vertical groove with a small width. When seen from the top, the conveying path 5 is formed in a U shape as a whole. The conveying path 5 includes a straight upstream conveying path portion 6, a curved conveying path portion 7 connected to the upstream conveying path portion 6, and a slightly-curved downstream conveying path portion 8 connected to the curved conveying path portion 7.

The upstream end of the upstream conveying path portion 6 communicates with a check insertion portion 9 formed of a vertical groove with a large width. The downstream end of the downstream conveying path portion 8 is connected to first and second check discharge portions 11 and 12, respectively, through branch paths 10*a* and 10*b* which branch right and left, respectively, the first and second check discharge portions 11 and 12 being formed of vertical grooves with a large width.

The check 4 which is to be read has a magnetic ink character 4A printed on the lower end portion of a front surface 4*a* thereof. On the front surface 4*a*, an amount, the name of a drawer, a number, a sign and so on are printed. On a rear surface 4*b* thereof, an endorsement block is provided.

(Structure for Carrying Checks)

Figure 3:
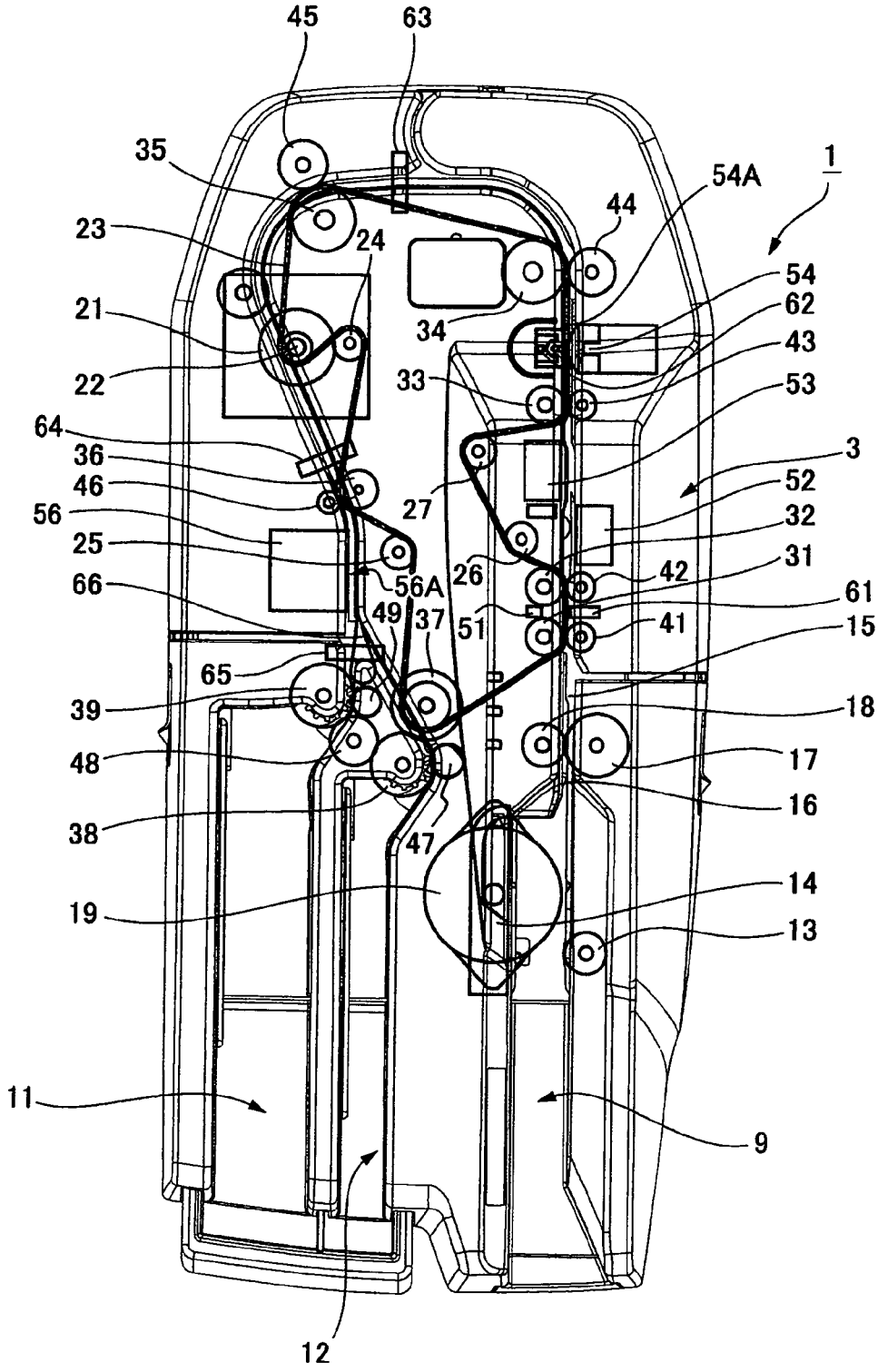
FIG. 3 is a diagram for explaining the internal structure of the check processing apparatus of FIG. 1.

As shown in FIG. 3, the check insertion portion 9 includes a feed roller 13 and a pressing member 14 disposed therein. The feed roller 13 serves to deliver the checks 4 toward the conveying path 5, the checks 4 being inserted in the check insertion portion 9 in a state where they are stacked therein. The pressing member 14 serves to press the checks 4 against the feed roller 13. The checks 4 fed by the feed roller 13 are delivered to the conveying path 5 through a feed passage 15 in which a separation pad 16 and a pair of a separation rollers composed of a separation roller 13 and a retard roller 18 are disposed. The separate pad 16 and the separating rollers 17 and 18 serves as a separation mechanism which separates the checks 4 sheet by sheet and then delivers the separated check 4 to the conveying path 5. The feed roller 13, the separation roller 17, and the pressing member 14 are driven by a common delivering motor 19.

Figure 4:
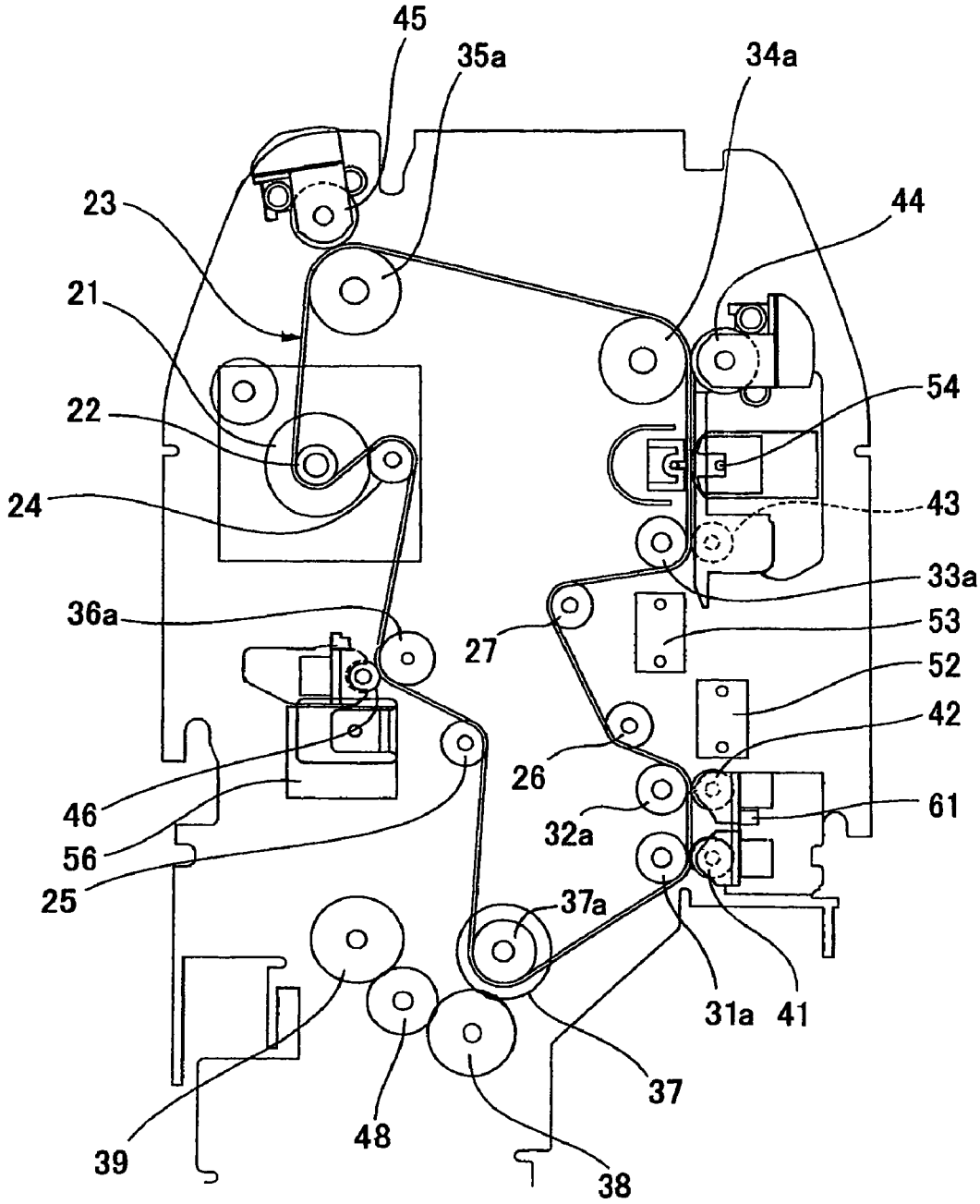
FIG. 4 is a diagram for explaining a structure for conveying checks.

Referring to FIGS. 3 and 4, the conveying mechanism will be described in more detail. The conveying mechanism, which carries the checks 4 along the conveying path 5, includes a conveying motor 21, a driving pulley 22 attached to a rotating shaft of the conveying motor 21, a plurality of conveying rollers 31 to 36 disposed along the conveying path 5, a intermediate gear 37, and a plurality of pressure rollers 41 to 46 which are pressed by the conveying rollers 31 to 36, respectively, so as to rotate. Further, the conveying mechanism includes a second discharge roller 38, which is geared with the rotation of the intermediate gear 37 through a spur gear, a transmission gear 48, a first discharge roller 39, and a pair of pressing rollers 47 and 49 which are pressed by the second and first discharge rollers 38 and 39 so as to rotate.

Further, the conveying mechanism includes an endless belt 23 for transmitting the rotation of the conveying motor 21 to the respective conveying rollers 31 to 36 and the intermediate gear 37. The endless belt 23 is moved along an endless track which starts from the driving pulley 22 and returns to the driving pulley 22 via a tension roller 24, a conveying-roller driven pulley 36*a*, a guide roller 25, a middle-gear driven pulley 37*a*, conveying-roller driven pulleys 31*a* and 32*a*, guide rollers 26 and 27, conveying-roller driven pulleys 33*a*, 34*a* (driven pulley of the second conveying roller), and 35*a* (driven pulley of the first conveying roller). The tension roller 24 biases the endless belt 23 to the inside through a spring (not shown) for providing tension to the endless belt 23. The endless track 23 of this embodiment is a timing belt having teeth formed on the inner circumference thereof. The driving pulley by which the endless belt 23 is moved and the respective driven pulleys, which are rotationally driven by the driving pulley 22 and the endless belt 23, have teeth formed on the outer circumference thereof, the teeth being geared with the teeth of the endless belt 23. The respective conveying rollers 31 to 36 have a driven pulley formed in the lower side thereof and a roller portion formed in the upper side thereof, the roller portion being formed of rubber or the like. The respective conveying rollers 31 to 36 are rotatably supported by a shaft formed in the side of a main body frame. The respective guide rollers 25 to 27 for changing a pathway of the endless belt 23 are formed in a cylindrical shape so as to abut on the outer circumference of the endless belt 23 and are rotatably supported in the side of the main body frame.

The conveying rollers 31 to 34 are respectively disposed in the boundary positions among the upstream end in the upstream conveying path portion 6, the middle position of the upstream conveying path portion 6, and the curved conveying path portion 7. The conveying roller 35 (the first conveying roller) is disposed in the downstream position in the curved conveying path portion 7. The conveying roller 36 is disposed in the middle position of the downstream conveying path portion 8, the intermediate gear 37 and the second discharge roller 38 are disposed in a discharge port of the second check discharge portion 12, and the first discharge roller 39 is disposed in a discharge port of the first check discharge portion 11.

Between the conveying rollers 31 and 32 in the upstream conveying path portion 6, a magnet 51 for magnetizing a magnetic ink character is disposed. Between the conveying rollers 32 and 33, a front-side contact image scanner 52 serving as a front-surface image reading unit and a rear-side contact image scanner 53 serving as a rear-surface image reading unit are disposed. Between the conveying rollers 33 and 34, a magnetic head 54 for reading a magnetic ink character is disposed.

In the downstream side of the conveying roller 36 in the downstream conveying path portion 8, a printing mechanism 56 is disposed. The printing mechanism 56 can be moved between a printing position and a wait position by a driving motor (not shown). In the printing position, the printing mechanism 56 is pressed against a check 4. In the wait position, the printing mechanism 56 is retreated from the printing position. The printing mechanism 56 may be a stamp mechanism which is pressed by a plunger so as to perform printing on a check 4.

In the conveying path 5, a variety of sensors for controlling the conveyance of checks are disposed. In a position adjacent to the magnet 51, a paper length detector 61 is disposed to detect the length of a check 4 which is delivered. In a portion facing the magnetic head 54, a double feed detector 62 is disposed to detect whether or not checks 4 are conveyed in a state where they are stacked. In a position in front of the conveying roller 35, a jam detector 63 is disposed. When checks 4 are continuously detected by the detector 63 for more than a predetermined time, the jam detector 63 determines that the conveying path 5 is jammed with checks. In the upstream position of the conveying roller 36, a printing detector 64 is disposed to detect the existence or non-existence of check 4 which is to be printed by the printing mechanism 56. Further, in the positions of the branch paths 10*a* and 10*b* that branch from the conveying path 5 into the first and second check discharge portions 11 and 12, respectively, a discharge detector 65 is disposed to detect checks discharged into the branch paths 10*a* and 10*b*.

At the upstream end of the branch paths 10*a* and 10*b*, a switching plate 66 is disposed which is switched by a driving motor (not shown). The switching plate 66 selectively switches the downstream end of the conveying path 5 with respect to the first and second check discharge portions 11 and 12, thereby guiding a check 4 to the selected discharge portion.

The length of the conveying path 5 from a read position 54A of the magnetic head 54 to a nip portion between the conveying roller 36 and the pressure roller 46 is larger than that of a check 4, which is to be read, in a long-side direction thereof (conveying direction). In this embodiment, the length of the conveying path 5 from the read position 54A to the nip portion is set to 240 mm which is longer than 8.75 inches which is the maximum length of the check 4 in ANSI (American National Standards Institute). Therefore, when the head of the check 4 reaches the nip portion between the conveying roller 36 and the pressure roller 46, it can be determined that the rear end thereof has already passed through the read position 54A of the magnetic head 54. Accordingly, while a magnetic ink character is read by the magnetic head 54, the check 4 is sequentially fed by the conveying roller 34 (second conveying roller) and the pressure roller 44, and the conveying roller 35 (first conveying roller) and the pressure roller 45. Further, while an image is read by the contact image scanners 52 and 53, the check 4 is sequentially fed by the conveying roller 33 and the pressure roller 43, the conveying roller 34 and the pressure roller 44, and the conveying roller 35 and the pressure roller 45.

(Positional Relationship of Carrying Rollers)

In the check conveying mechanism of this embodiment, the positions of the respective rollers wound by the endless belt 23 are set as follows. As shown in FIG. 4, the endless belt 23 is wound around the conveying-roller driven pulley 35*a* (the driven pulley of the first conveying roller) adjacent to the upstream side in the belt-driven direction which is a tight side in the endless belt 23 with respect to the driving pulley 22. Further, the endless belt 23 is wound around the conveying-roller driven pulley 34*a* (the driven pulley of the second conveying roller) adjacent to the upstream side of the conveying-roller driven pulley 35*a* (the driven pulley of the first conveying roller). Further, the endless belt 23 is wound around the conveying-roller driven pulleys 33*a*, 32*a*, and 31*a*, the middle-gear driven pulley 37*a*, and the conveying-roller driven pulley 36*a*, respectively, toward the upstream side of the belt-driven direction.

When checks 4 are conveyed while being sequentially fed by the respective conveying rollers 31 to 36 and the driven pulley 37, a variation in tension of the endless belt 23 which is generated in the wound portion of one conveying roller and a variation in load of each spindle caused by the variation in tension are sequentially added to the driven pulley of the adjacent conveying rollers and are then amplified toward the upstream side of the driving pulley 22 which is the driven position of the endless belt 23. Therefore, the variation in tension, which is generated in the driven pulleys of the respective conveying rollers, increases in the direction of an order of the respective conveying-roller driven pulleys 35*a*, 34*a*, 33*a*, 32*a*, and 31*a*, the middle-gear driven pulley 37*a*, and the conveying-roller driven pulley 36*a*.

In this embodiment, a portion where the variation in tension of the endless belt 23 is the smallest is set to the wound portion of the driven pulley 35*a* of the first conveying roller 35, a portion where the variation in tension is the second smallest is set to the wound portion of the driven pulley 34*a* of the second conveying roller 34, and a portion where the variation in tension is the third smallest is set to the wound portion of the driven pulley 33*a* of the conveying roller 33.

As described above, the conveying roller 34 (the second conveying roller) and the conveying roller 35 (the first conveying roller) are disposed in positions where the check 4 is fed while the magnet ink character is read by the magnetic head 54. Further, the conveying rollers 33 to 35 are disposed in positions where the check 4 is fed while the image is read by the contact image scanners 52 and 53. When a large variation in tension is applied to the conveying rollers 33 to 35 while the check is fed, a deflection amount of spindles of the rollers is significantly varied. In accordance with the variation in deflection amount, a moved amount of the belt and a driven amount of the conveying motor are not proportional. As a result, when the check 4 is fed, the check conveying speed may be disturbed. Then, the reading precision of a magnetic ink character by the magnetic head 54 and the reading precision of an image by the contact image scanners 52 and 53 may be degraded. In particular, the reading precision of the magnetic head 54 is easily affected by the disturbance in the check conveying speed.

In this embodiment, the first conveying roller 35 and the second conveying roller 34, by which the check 4 is fed while the magnetic ink character is read by the magnetic head 54, are disposed in positions where a variation in tension in the endless belt 23 is smaller than in the other positions. Therefore, the disturbance in the check conveying speed can be prevented. As a result, it is possible to prevent or avoid the degradation of the reading precision by the magnetic head 54. Similarly, in the conveying roller 33 by which the check 4 is fed while the image is read by the contact image scanners 52 and 53, the endless belt 23 is wound around a portion of the conveying roller 33 where a variation in tension in the endless belt 23 is smaller than in the conveying rollers 32 and 31, the intermediate gear 37, and the conveying roller 36. Therefore, it is possible to prevent or avoid the degradation of the image reading precision.

Further, in this embodiment, a portion where the variation in tension of the endless belt 23 is the largest is set to the wound portion of the driven pulley 36*a* of the conveying roller 36. When the head of the check 4 reaches the nip portion between the pressure roller 46 and the conveying roller 36 which is rotated by the driven pulley 36*a*, the rear end of the check 4 has already passed through the read position 54A of the magnetic head 54. Therefore, the largest variation in tension at the wound portion of the driven pulley 36*a* does not effect the image reading precision.

In this embodiment, as shown in FIG. 4, the outer diameters of the conveying rollers 34 and 35, by which the check 4 is fed while the magnetic ink character is read by the magnetic head 54, are set to be larger than those of the other conveying rollers 31, 32, 33, and 36. Similarly, the outer diameters of the respective pressure rollers 43 and 44 for pressing the check 4 against the conveying rollers 34 and 35 are also set to be larger than the other pressure rollers 41, 42, 45, and 46.

As the outer diameters of the rollers are set to be larger, it is possible to reduce a reaction force acting on the check 4 when the check 4 is fed to nip portions of these rollers. As a result, when the check 4 which is conveyed while the magnetic ink character is read is fed to the conveying rollers 34 and 35, it is possible to prevent the disturbance in the conveying speed. Therefore, it is possible to reliably prevent the degradation of the reading precision of the magnetic ink character by the magnetic head 54.

(Control System)

Figure 5:
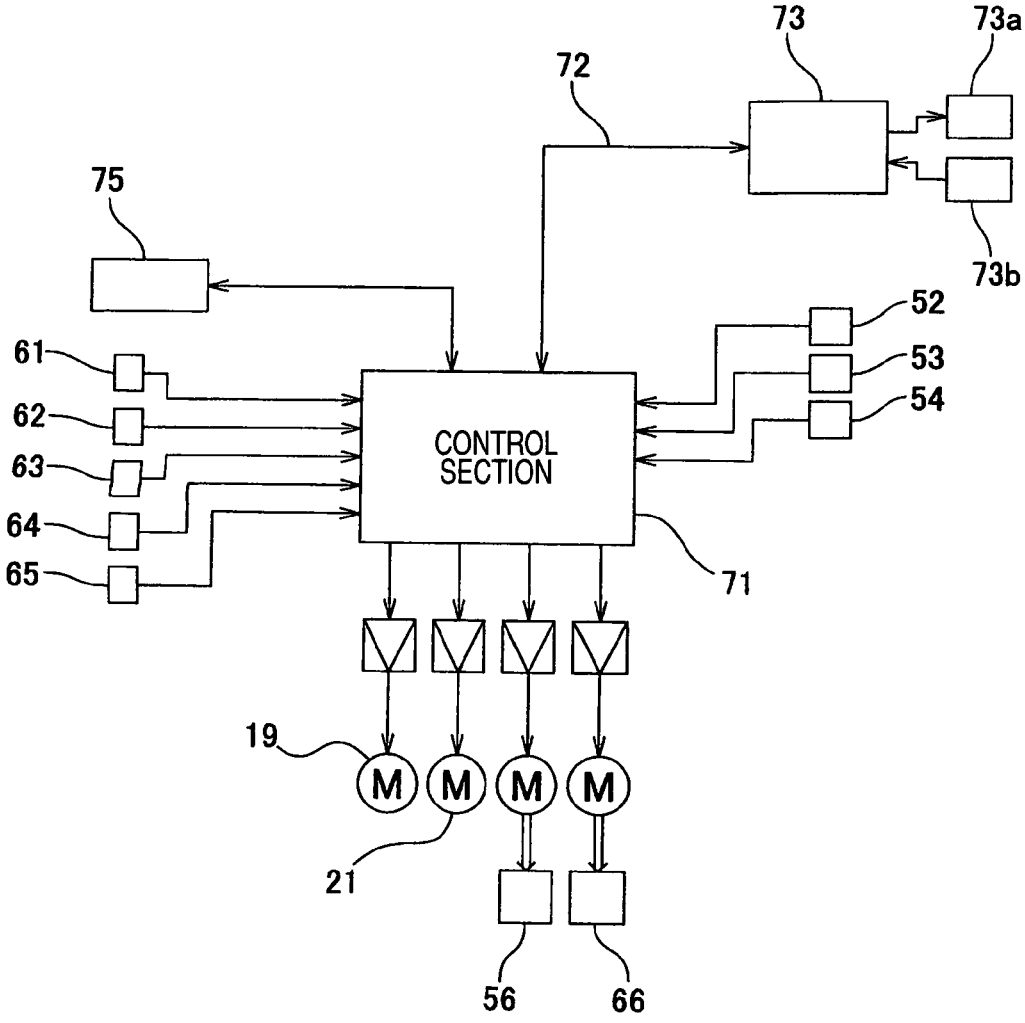
FIG. 5 is a block diagram of a control system of the check processing apparatus of FIG. 1.

As shown in FIG. 5, the control system of the check processing apparatus 1 includes a ROM (Read-Only Memory), a RAM (Random Access Memory), and a control section 71 having a CPU (Central Processing Unit) provided in the center thereof. The control section 71 is connected to a host computer system 73 through a communication cable 72. The computer system 73 includes a display device 73*a* and an input/output device composed of a manipulation section 73*b* such as a keyboard or a mouse. A start instruction of check reading operation or the like is input to the control section 71 from the computer system 73.

When the start instruction of check reading operation is received, the control section 71 drives the delivering motor 19 (see FIG. 3) and the conveying motor 21 so as to deliver checks 4 to the conveying path 5 sheet by sheet, and the delivered checks 4 are conveyed along the conveying path 5. The control section 71 receives information on front-surface and rear surface images of each check 4, which is read by the front-side and rear-side contract scanners 52 and 53, and information on magnetic ink character of the check 4 which is read by the magnetic head 54. The information is supplied to the computer system 73 such that image processing and character recognition processing are performed. Then, it is determined whether the reading is normally performed or not, and the determination result is supplied to the control section 71. The control section 71 controls the driving of the printing mechanism 56 and the switching plate 66 based on the determination result.

The conveyance control of the check 4 by the control section 71 is performed on the basis of detection signals from the paper-length detector 61, the double-feed detector 62, the jam detector 63, the printing detector 64, and the discharge detector 65, which are disposed in the conveying path 5. Further, the control section 71 is connected to a manipulation section 75 including a manipulation switch such as a power switch formed in the main body case 2.

(Check Processing Operation)

Figure 6:
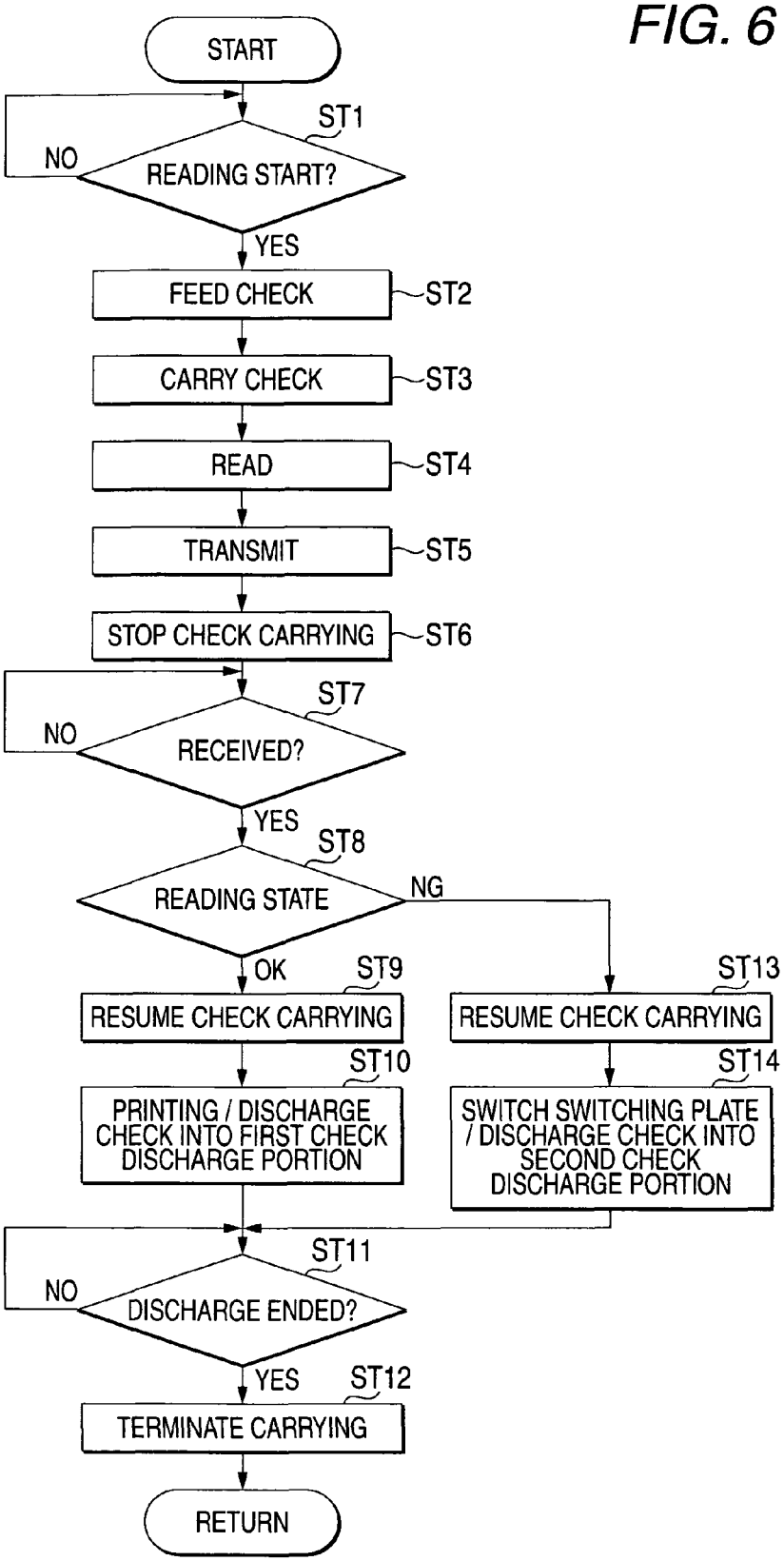
FIG. 6 is a flow chart showing the operation of the check processing apparatus of FIG. 1.

As shown in FIG. 6, with reference to the flow chart, the reading operation will be described. First, when an operator inputs a reading start instruction through the manipulation section 73*b* of the host computer system 73, the feed roller 13 is rotated by the delivering motor 19, and the pressing member 14 is moved to press checks 4 against the feed roller 13. As a result, the checks 4 are delivered by the feed roller 13. The checks 4 fed into the delivery passage 15 are separated sheet by sheet by the separation mechanism (the separation pad 16, the separation roller 17, and the retard roller 18) disposed in the delivering passage 15 so as to be delivered to the conveying path 5 (Steps ST1 and ST2).

When the leading end of the delivered check 4 is detected by the paper-length detector 61, the conveying motor 21 is driven to rotationally drive the respective conveying rollers 31 to 36 and the intermediate gear 37. The delivered check 4 is conveyed along the conveying path 5 while being sequentially transferred to the conveying rollers 31 to 36 (Step ST3). The front-surface and rear-surface images and the magnetic ink character of the conveyed check 4 are read by the front-side and rear-side contact image scanners 52 and 53 and the magnetic head 54, respectively (Step ST4).

The read information is transmitted to the host computer system 73 through the communication cable 72 (Step ST5). The computer system 73 processes the read front-surface and rear surface images and the read magnetic ink character and determines whether the reading is normally performed or not. When the check 4 is conveyed upside down, the magnetic ink character cannot be recognized. Therefore, it is determined that the reading is abnormally performed. When the check 4 is conveyed in a state where the surface thereof is upside down, the information on the magnetic ink character cannot be obtained. Therefore, it is determined that the reading cannot be performed. Further, when the check 4 is folded, torn, or skewed while being conveyed, a portion of the magnetic ink character cannot be read. In this case, it is also determined that the reading is abnormally performed. Further, when the check 4 is folded, torn, or skewed while being conveyed, predetermined information such as information on the amount and so on cannot be recognized from the image information of the rear surface of the check 4. In this case, it is also determined that the reading is abnormally performed.

When the leading end of the conveyed check 4 reaches the printing position 56A of the printing mechanism 56, the check processing apparatus 1 temporarily stops the conveying operation of the check 4 (Step ST6). The leading end position of the conveyed check 4 is managed by the number of steps of the conveying motor 21 from a point of time where the leading end of the check 4 is detected by the paper-length detector 61. In a state where the conveyance of the check 4 is stopped, the check processing apparatus 1 waits for the determination result of whether the reading is normally performed or not, the determination result being received from the computer system 73 (Step ST7).

After the determination result is received, and when the determination result indicates that the reading is normally performed, the conveyance of the check 4 is resumed, and simultaneously, the printing mechanism 56 is moved to the printing position (Steps ST8 and ST9). While a sentence saying 'Electric Payment Settled' or the like is printed by the printing mechanism 56, the check 4 is conveyed and is then discharged to the first check discharge portion 11 by the switch plate 66 (Step ST10). After the rear end of the check 4 is detected by the discharge detector 65, the check conveying operation is completed (Steps ST11 and ST12). Then, the next check 4 is delivered and starts to be conveyed.

On the other hand, when the determination result indicates that the reading is abnormally performed or cannot be performed (Step ST8), the conveyance of the check 4 is resumed (Step ST13), and simultaneously, the switching operation of the switching plate 66 is performed. The printing mechanism 56 is held in the wait position and does not perform printing onto the check 4. The check 4 is distributed to the second check discharge portion 12 by the switch plate 66 so as to be discharged (Step ST14). After the rear end of the check 4 is detected by the discharge detector 65, the check conveying operation is completed (Steps ST11 and ST12). Then, the next check 4 is delivered and starts to be conveyed.

When the double feeding of checks is detected by the double-feed detector 62, interruption processing is performed, and the conveyance is immediately stopped. For example, a warning indicating that an abnormality occurs in the conveyance is noticed through a warning lamp disposed in the manipulation section 75. Then, the checks are detached from the conveying path 5 such that the check processing apparatus waits for the initial state. Similarly, even when the jam detector 63 detects that the conveying path 5 is jammed with checks, the interruption processing is performed.

(Effects by Check Processing Apparatus)

In the above-described check processing apparatus 1, a portion of the endless belt 23 where the variation in tension is smaller than the other portions is wound around the conveying roller 34 and 35, by which the check 4 is fed while the magnetic ink character is read by the magnetic head 54. Therefore, when the check 4 is fed, the variation in load acting on the conveying rollers 34 and 35 can be prevented, which makes it possible to prevent the disturbance in the conveying speed of the check 4 while the magnetic ink character is read.

Further, the outer diameters of the conveying rollers 34 and 35 are set to be larger than those of the other conveying rollers, and the outer diameters of the pressure rollers 43 and 44 which are pressed against the conveying rollers 34 and 35 are set to be larger than those of the other pressure rollers. Accordingly, the reaction force acting on the check 4 fed to the nip portions of the conveying rollers 34 and 35 and the pressure rollers 44 and 45 can be reduced, which makes it possible to prevent the disturbance in the conveying speed of the check 4 while the magnetic ink character is read. Therefore, it is possible to prevent or avoid the degradation of reading precision of the magnetic ink character, which is caused by the disturbance in the conveying speed.

Further, a portion of the endless belt 23 where the variation in tension is smaller than the other portions is wound around the conveying rollers 33, 34, and 35 by which the check 4 is fed while the image is read by the contact image scanners 52 and 53. Therefore, when the check 4 is fed, the variation in load acting on the conveying rollers 33, 34, and 35 can be prevented, which makes it possible to prevent the disturbance in the conveying speed of the check 4 while the image is read. Accordingly, it is possible to prevent or avoid the degradation of reading precision of the image, which is caused by the disturbance in the conveying speed.

Other Embodiments

The example where the present invention is applied to the check processing apparatus has been described in the above-described embodiment. However, the invention may be applied to an apparatus which processes other sheet-shaped mediums, for example, a printer or scanner.

Further, the construction of the endless belt and the pulley is not limited to the timing belt, but may be a flat belt, a V belt, or a round belt and a pulley corresponding to each belt. However, the transmission by the timing belt is preferable, in order to reliably transmit a variation in speed.

In the above-described embodiment, it has been described that the conveying roller 35 as the first conveying roller is rotated by the driving pulley 22 attached to the rotating shaft of the conveying motor 21 through the endless belt 23. However, when the driven pulley 35*a* of the first conveying roller is directly driven by the motor 21, the variation in speed for the endless belt is reduced. Therefore, it is preferable that the driven pulley 35*a* of the first conveying roller is directly driven by the motor 21.

In the above-described embodiment, the length of the conveying path 5 from the read position 54A of the magnetic head 54 which serves as the information reading unit disposed downstream in the belt moving direction to the nip portion between the conveying roller 36 and the pressure roller 46 is set to 240 mm. However, the length have only to be longer than 8.75 inches so that the check 4 is not nipped between the conveying roller 36 and the pressure roller 46 during the information on the check 4 is read by the information reading unit. In a case where the contact image scanner 52 is disposed downstream from the magnetic head 54 in the belt moving direction, the length corresponds to a length from a read position of the contact image scanner 52 to the nip portion between the conveying roller 36 and the pressure roller 46. Further, in the above-described embodiment, the length is set longer than the maximum length of any checks in common use worldwide. If the check processing apparatus is used for only a specific check which has a relatively short length, the length from the read position to the nip portion may be set shorter than 8.75 inches. However, it is desirable to set the length longer than 8.75 inches in order to process any checks in common use worldwide by a single model of the medium processing apparatus.

What is claimed is:

1. A medium processing apparatus comprising:

a medium conveying mechanism operable to convey a specific sheet medium along a medium conveying path in a medium conveying direction; and an information reading section operable to read information recorded on a recording area of the medium when the recording area of the medium passes through an information reading position on the medium conveying path;

wherein the medium conveying mechanism includes:

a motor;

a driving pulley adapted to be rotated by the motor;

an endless belt wound around the driving pulley in a tensile state and adapted to be moved by the driving pulley in a belt moving direction;

a first driven pulley around which the endless belt is wound in a tensile state and adapted to be rotated by the endless belt;

a first conveying roller disposed on the medium conveying path and adapted to be rotated by the first driven pulley to convey the medium;

a first pressure roller disposed to correspond to the first conveying roller so as to press the medium against the first conveying roller;

a second driven pulley around which the endless belt is wound in a tensile state and adapted to be rotated by the endless belt;

a second conveying roller disposed between the first conveying roller and the information reading position on the medium conveying path and adapted to be rotated by the second driven pulley to convey the medium;

a second pressure roller disposed to correspond to the second conveying roller so as to press the medium against the second conveying roller;

a third driven pulley around which the endless belt is wound in a tensile state and adapted to be rotated by the endless belt;

a third conveying roller disposed on the medium conveying path and adapted to be rotated by the third driven pulley to convey the medium; and a third pressure roller disposed to correspond to the third conveying roller so as to press the medium against the third conveying roller, wherein a distance in the medium conveying path between the information reading position and a nip portion between the first conveying roller and the first pressure roller is set so that the medium is nipped between the first conveying roller and the first pressure roller when the information reading section reads the medium; and wherein the first driven pulley is disposed upstream of the driving pulley in the medium conveying direction;

wherein the second driven pulley is disposed upstream of the first driven pulley in the medium conveying direction;

wherein the third conveying roller is disposed at a position other than between the first conveying roller and the information reading position on the medium conveying path; and wherein the third pressure roller is disposed at a position other than between the first pressure roller and the information reading position on the medium conveying path, wherein a diameter of the first conveying roller is larger than a diameter of the third conveying roller; and wherein a diameter of the first pressure roller is larger than a diameter of the third pressure roller.

2. The medium processing apparatus as set forth in claim 1, wherein the endless belt has teeth thereon; and wherein the driving pulley and the first driven pulley have teeth thereon so as to be engaged with the endless belt.

3. The medium processing apparatus as set forth in claim 1, wherein a diameter of the second conveying roller is larger than a diameter of the third conveying roller; and wherein a diameter of the second pressure roller is larger than a diameter of the third pressure roller.

4. The medium processing apparatus as set forth in claim 1, wherein the information reading section includes a magnetic head operable to read a magnetic ink character.

5. The medium processing apparatus as set forth in claim 1, wherein the information reading section includes an image reading section.

6. The medium processing apparatus as set forth in claim 1, the information reading section includes a magnetic head operable to read a magnetic ink character and an image reading section; and the magnetic head is disposed downstream of the image reading section in the medium conveying direction.

7. The medium processing apparatus as set forth in claim 1, wherein a variation in tension of the endless belt at a wound portion of the first driven pulley is less than a variation in tension of the endless belt at a wound portion of the second driven pulley, which is less than a variation in tension of the endless belt at a wound portion of a third driven pulley.

8. The medium processing apparatus as set forth in claim 1, wherein a variation in tension of the endless belt at a wound portion of the first and second driven pulley is less than a variation in tension of the endless belt in positions away from the first and second driven pulley.

9. The medium processing apparatus as set forth in claim 1, wherein the first driven pulley is driven directly by the motor.

10. The medium processing apparatus as set forth in claim 1, wherein the medium conveying mechanism further includes:

a fourth driven pulley around which the endless belt is wound in a tensile state and adapted to be rotated by the endless belt;

a fourth conveying roller disposed on the medium conveying path and adapted to be rotated by the fourth driven pulley to convey the medium; and a fourth pressure roller disposed to correspond to the fourth conveying roller so as to press the medium against the fourth conveying roller;

wherein the fourth driven pulley is disposed directly downstream of the driving pulley in the medium conveying direction; and wherein a distance in the medium conveying path between the information reading position and a nip portion between the fourth conveying roller and the fourth pressure roller is longer than the distance between a leading end of the conveyed medium and back end of the recording area.

11. The medium processing apparatus as set forth in claim 10, wherein a variation in tension of the endless belt at a wound portion of the first driven pulley is less than a variation in tension of the endless belt at a wound portion of the fourth driven pulley.

12. The medium processing apparatus as set forth in claim 1, wherein the sheet medium includes a check;

wherein the medium processing apparatus includes a check scanner operable to read the information recorded in the check.

* * * * *